US005499750A

United States Patent [19]

Manifold

[11] Patent Number: 5,499,750

[45] Date of Patent: Mar. 19, 1996

[54] SPRAYING DEVICE HAVING A REMOVABLE AND REPLACEABLE BLADDER

[76] Inventor: William J. Manifold, 249 John Knox Rd., Tallahassee, Fla. 32303

[21] Appl. No.: 374,034

[22] Filed: Jan. 17, 1995

[51] Int. Cl.[6] ..... B67D 5/42

[52] U.S. Cl. ..... 222/386.5; 222/395; 239/328

[58] Field of Search ..... 222/95, 105, 183, 222/323, 211, 214, 395, 384, 386.5, 465.1, 464; 239/322, 323, 328, 337, 373

[56] References Cited

U.S. PATENT DOCUMENTS

| | | | |
|---|---|---|---|
| 4,043,510 | 8/1977 | Morris | 239/328 |
| 4,635,848 | 1/1987 | Little | 239/323 |
| 4,785,974 | 11/1988 | Rudick et al. | 222/211 |
| 4,886,212 | 12/1989 | Proctor et al. | 239/315 |

*Primary Examiner*—Andres Kashnikow
*Assistant Examiner*—Philippe Derakshani
*Attorney, Agent, or Firm*—Carnes, Cona and Dixon

[57] ABSTRACT

The spraying device of the present invention includes a container having a hollow interior, a threaded open top, and a closed bottom. The enclosed bottom includes an orifice that is adapted to receive a pressurized fluid line. A flexible bladder is inserted through the open top into the container. A cap is adapted to be removably secured to the open top of the container. Extending through the cap is a through hole which receives a conduit that extends from the interior of the bladder to the exterior of the container. A spraying mechanism is attached to the exterior end of the conduit. Utilization of the device occurs when fluid from the pressurized fluid line enters the interior of the container exerts pressure on the bladder to cause the bladder to contract and force the fluid located inside to escape via the conduit and spraying mechanism.

5 Claims, 1 Drawing Sheet

SPRAYING DEVICE HAVING A REMOVABLE AND REPLACEABLE BLADDER

BACKGROUND OF THE INVENTION

1. Field of the Invention

The present invention relates generally to a spraying device and more particularly to a spraying device that includes a removable, replaceable, flexible, collapsible, and resilient bladder which houses a chemical substance and when utilized uses a water line for applying pressure to the bladder so that the chemical substance can be dispersed.

2. Description of the Prior Art

It has long be held that spraying devices are used to apply a chemical substance onto a surface. Many commercially available sprayers consist of a container having a hollow interior. Water and a chemical additive, such as insecticide or fertilizer, are mixed within the hollow interior to provide a solution. A pumping means is then utilized to pump air into the hollow interior and thus pressurize it. This arrangement permits a pressurized stream to flow when the substance is release. A problem associated with a pumping means is that an individual must continually pump the mechanism in order to maintain a constant pressure within the container. This pumping can be tiresome and time consuming. Additionally people with limited dexterity, such as the elderly and arthritics find the pumping process to be virtually impossible to perform.

Another device is disclosed in U.S. Pat. No. 4,886,212, issued to Proctor et al., wherein a spraying device includes a resilient bladder inserted into the hollow interior of a container. Proctor's spraying device is complex and includes a plurality of selections. An individual is able to select the use of water only, the use of the substance located within the bladder only, or a combination thereof. In providing these options, a conduit extends internally within the housing and extends though a supporting flange of the bladder. This arrangement makes it virtually impossible to remove and replace the bladder without disassembling the apparatus.

None of these previous spraying devices, however, provide the benefits intended with the present invention. Additionally, prior techniques do not suggest the present inventive combination of component elements as disclosed and claimed herein. The present invention achieves its intended objectives and advantages over the prior art device through a new, useful and unobvious combination of component elements, which is simple to use, has a minimum number of functioning parts, can be manufactured, assembled and tested at reasonable cost, and employs only readily available material.

SUMMARY OF THE INVENTION

The present invention provides for a spraying device which consists of a container having a hollow interior chamber which houses a removable, replaceable, resilient bladder which contains a chemical substance. The bladder includes an open top and an enclosed bottom end.

The container further includes a bottom portion and a top portion. The top portion includes a threadably attachable cap. Once the cap is removed, an opening is exposed through the container to the interior chamber. This opening receives the enclosed bottom end of the collapsible bladder.

Extending through the cap is a through hole which receives a conduit. This conduit extends from the interior area of the resilient bladder to the outside of the container. A spraying mechanism is attached to the exterior end of the conduit to permit the chemical substance located within the bladder to be sprayed.

The bottom portion of the container includes an inlet has a first end and a second end. The second end faces the interior chamber of the container while the first end is adapted to receive a pressurized fluid line (i.e. water hose). A control valve, for controlling the pressure of the fluid line, engages the first end of the inlet. Accordingly, in order to operate the device, a pressurized fluid enters the interior chamber of the container. The fluid exerts an external pressure on the bladder to cause the bladder to collapse and force the chemical substance within the bladder to escape via the conduit.

The configuration and design of this spraying device offers several advantages over the prior art.

Accordingly, it is the object of the present invention to provide a spraying device that is easy to operate and durable.

It is a further object of the present invention to provide a spraying device that will permit a user to spray a variety of chemicals without contacting or handling the actual chemical, thereby increasing the safety of the present invention.

It is yet another object of the present invention to provide a spraying device that includes a bladder which is replaceable.

A final object of the present invention, is to provide a spraying device which will conform to conventional forms of manufacture, be of simple construction and easy to use so as to be economically feasible, long lasting and relatively trouble free in operation.

Although there have been many inventions related to a spraying device, none of the inventions have been sufficiently compact, low cost, and reliable enough to become commonly used. The present invention meets the requirements of simple design, compact size, low initial cost, low operating cost, ease of installation and maintainability, and minimal amount of training to successfully employ.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
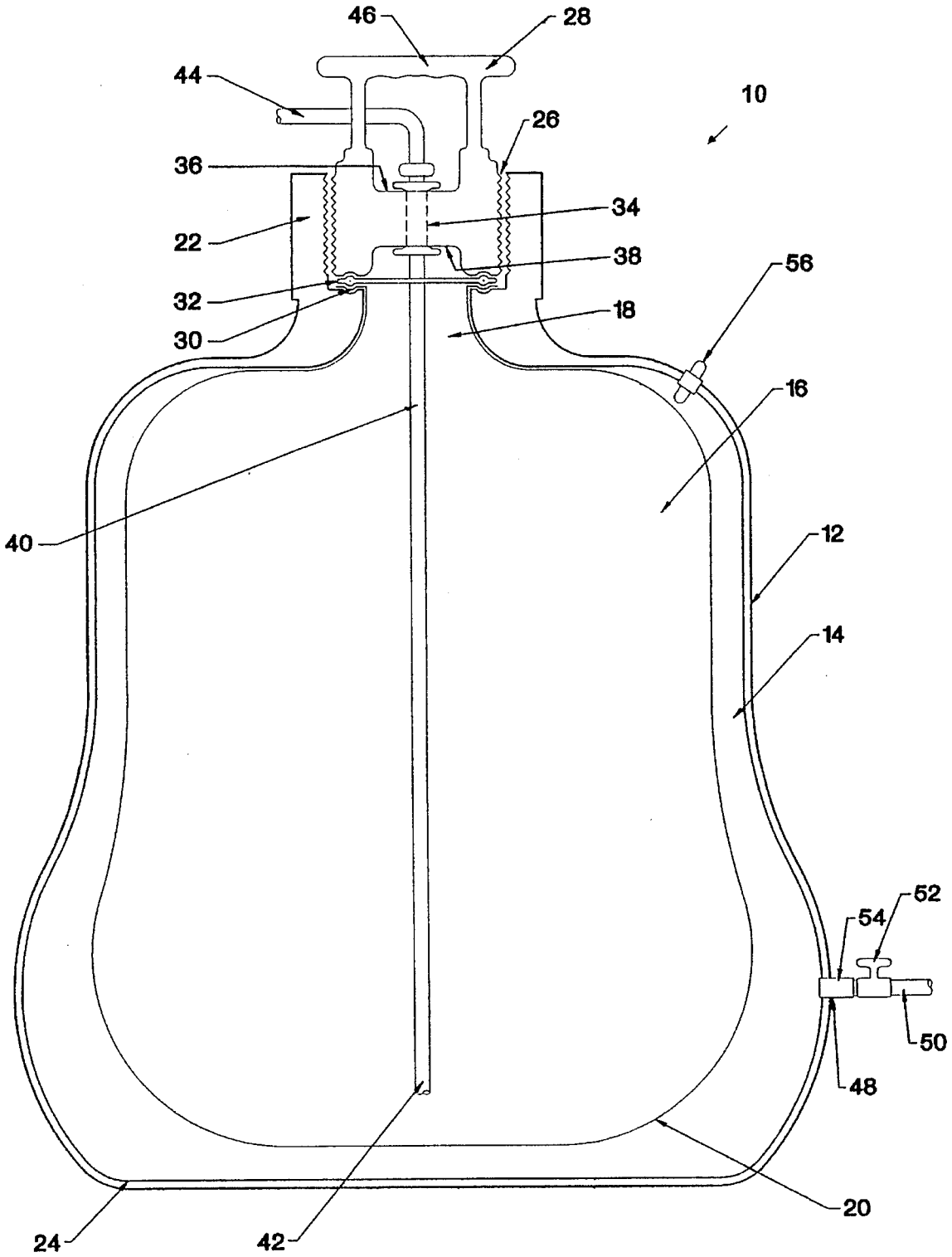
FIG. 1 illustrates a cross sectional view of the spraying device of the present invention.

FIG. 1 illustrates the present invention. As illustrated, the spraying device 10 consists of a hollow container 12 having an interior chamber 14. The interior chamber 14 receives a resilient, replaceable, and collapsible bladder 16. This collapsible and replaceable bladder includes an open top end 18 and a closed bottom end 20. The open top includes a lip 30. An O-ring 32 is enclosed within the lip of the bladder (partially illustrated). This O-ring 32 provides for the open top end 18 of the bladder to maintain a circular and open position.

The container 12 further includes a top portion 22 and a bottom portion 24. This top portion 22 includes a threaded opening 26 that receives a threaded cap 28. The bladder 16 is received through this threaded opening 26. This cap 28 is adapted to be removably secured to the top portion of the threaded opening. Once attached, the cap 28 is internally located within the top portion of the container and engages the lip of the bladder. This arrangement will provide for the bladder to be maintained in a fixed and secured position via the cap.

The cap further includes a channel 34 that extends from the top surface 36 of the cap to the bottom surface 38 of the cap. A conduit 40 having a first end 42 and a second end 44 extends though the channel 34. The first end 42 is located near the bottom of the bladder while the second end extends out from the top surface 36 of the cap. This second end 44 is adapted to be removably secured to any conventional wand (not illustrated) that will permit the chemical substance within the bladder to be sprayed effectively.

For convenient carrying of the spraying device a handle 46 is attached to the top surface of the cap. Additionally, the lower area of the container or housing 12 can be increased in size, as illustrated this figure so as to increase the stability of the apparatus and to avoid any possibility of tipping over.

Further for added ease in moving the apparatus, wheels (not illustrated) may be attached to the bottom surface thus enabling a user to push or pull it to a desired location.

Located near the bottom of the hollow container is an inlet 48. This inlet is adapted to engage with a conventional pressurized hose line 50 (partially illustrated). This inlet 48 consists of a first end and a second end. The second end faces into the interior chamber 14 of the container or housing 12. Facing the first end is a cutoff valve 52. This valve 52 is an on/off valve or switch and will enable the water from the pressurized hose line to flow into the interior chamber of the housing. Located between the cutoff valve 52 and the first end is a pressure reducer valve 54. This pressure reducer valve 54 alters the pressure flowing therein. This pressurized fluid flow will exert an external force onto the outer surface of the bladder and force the bladder to compress. This compression will force the chemical substance within the bladder to escape via the conduit. From the conduit the chemical is transported to the sprayer in order to be dispersed.

A pressure relief valve 56 releases any pressure build-up after the spraying device as been used. This will enable the user to safely remove the top and discard the bladder.

In order to utilize the spraying device 10 of the present invention, a bladder 16 is placed within the interior chamber 14. The cap 28 is placed on the device to secure the bladder in a fixed position. The pressurized fluid line is turned on and then the cutoff valve is opened. As fluid enters into the interior chamber, pressure is exerted on the outer surface of the bladder to cause the bladder to collapse and force the chemical substance within the bladder to escape via the conduit. The fluid flow into the interior chamber is controlled by way of the pressure reducer valve.

After use of the spraying device, the pressure build-up within the interior chamber is released by the pressure relief valve. The interior chamber is drained and the bladder removed.

While the invention has been particularly shown and described with reference to an embodiment thereof, it will be understood by those skilled in the art that various changes in form and detail may be made without departing from the spirit and scope of the invention.

I claim:

1. A sprayer device comprising:

a housing having a hollow interior chamber for receiving a removable, collapsible and resilient bladder;

said housing including an enclosed bottom area and an internally threaded open top;

said internally threaded open top receives an enclosed bottom of said bladder to provide for an open top of said bladder to be located in proximity to said internally threaded open top of said housing;

an externally threaded cap is adapted to be removably secured to said internally threaded open top;

a conduit having a first end and a second end extends through a centrally located channel in said externally threaded cap and said first end is received in proximity to said enclosed bottom of said bladder and said second end extends outwardly from said centrally located channel and said second end is adapted to receive a wand;

an inlet is in proximity to said enclosed bottom area and extending into said interior chamber, said inlet including a threaded opening for receiving a pressurized hose line, an on/off valve, and an pressure reducer valve for controlling pressure of a fluid flow of said pressurized hose line; and a pressure relief valve extending into said interior chamber for relieving the pressure located within said interior chamber after use of said spraying device.

2. A spraying device as in claim 1 wherein said cap further includes a handle.

3. A spraying device as in claim 2 wherein said housing further includes a middle area located between said open top and said enclosed bottom area and said enclosed bottom area of said housing is wider and larger in size than said middle area to provide an added stability of said spraying device.

4. A spraying device as in claim 3 wherein said enclosed bottom further includes a top surface and a bottom surface and said top surface faces said interior chamber and said bottom surface includes a plurality of wheels.

5. A spraying device as in claim 1 wherein said open bladder further includes a lip and said lip wraps around an O-ring.

* * * * *